US005251867A

United States Patent [19]

Beacom

[11] Patent Number: 5,251,867

[45] Date of Patent: Oct. 12, 1993

[54] HEADER PALLET

[76] Inventor: Roger Beacom, 241 Sorrento Ranches Dr., Nokomis, Fla. 34275

[21] Appl. No.: 865,876

[22] Filed: Apr. 9, 1992

[51] Int. Cl.[5] ..... B28B 21/76

[52] U.S. Cl. ..... 249/100; 249/102; 425/183

[58] Field of Search ..... 249/99, 100, 98, 48, 249/89, 102, 144; 425/183, 193, 262, 427, DIG. 218, DIG. 44, 452

[56] References Cited

U.S. PATENT DOCUMENTS

| | | | |
|---|---|---|---|
| 2,602,469 | 7/1952 | Whiting | 249/100 |
| 2,929,124 | 3/1960 | James | 249/100 |
| 3,922,133 | 11/1975 | Crawford et al. | 249/100 |
| 4,014,739 | 3/1977 | Granberg | 249/113 |
| 4,522,669 | 6/1985 | Nordin et al. | 425/127 |
| 4,562,032 | 12/1985 | Gaudreau | 425/DIG. 44 |
| 5,082,614 | 1/1992 | Hartmann et al. | 249/100 |

FOREIGN PATENT DOCUMENTS

| | | | |
|---|---|---|---|
| 203410 | 6/1955 | Australia | 249/100 |
| 3422483 | 12/1985 | Fed. Rep. of Germany | 249/100 |
| 3638547 | 5/1988 | Fed. Rep. of Germany | 249/100 |

*Primary Examiner*—Khanh P. Nguyen
*Attorney, Agent, or Firm*—A. W. Fisher, III

[57] ABSTRACT

A header pallet for the manufacture of the spigot of a concrete pipe to receive a sealing gasket during assembly of a pipe line including an outer header ring having an end leg portion and a side leg portion to cooperatively form a substantially L-shaped profile wherein the intersection of the inner surface of the end leg portion and the inner surface of the side leg portion are contoured to form a concave surface and a shoulder is formed on the inner surface of the side leg portion in spaced relationship relative to the concave surface, a removable compressible intermediate ring having a substantially arcuate profile including an outer convex surface, and a removable inner snap ring having a substantially rectilinear profile such that the removable inner snap ring is placed to engage the shoulder in spaced relationship relative to the end leg portion and the removable compressible intermediate ring is press fitted between the removable inner snap ring and the end leg portion with the outer convex surface thereof mating with the concave surface to form on the spigot of the concrete pipe.

1 Claim, 3 Drawing Sheets

HEADER PALLET

BACKGROUND OF THE INVENTION

1. Field of the Invention

A header pallet for the manufacture of a single offset notch on the end of the spigot of a concrete pipe to receive a sealing gasket during assembly of a pipe line.

2. Description of the Prior Art

It is common practice to make concrete pipe sections with a bell and spigot end utilizing a resilient packing ring or sealing gasket between the bell and spigot ends of interconnected pipe sections. In order to provide a retaining means for a sealing ring or gasket, it is common practice to provide an inwardly extending annular groove in the spigot end of the pipe sections.

Typically concrete pipe is produced by one of several molding methods, such as by centrifugal spinning or by the more common casting in vertical molds vibrated to compact the concrete or casting in fixed vertical molds with the compacting performed by a moving core. In the latter technique, it is also common practice to utilize some form of separate mold or former to make the ring receiving groove or channel in the spigot end of the pipe. The pipes are usually molded bell end down and spigot end up. These auxiliary molds or spigot groove formers are generally placed on top of the mold. There is a common problem encountered in this spigot groove forming in that in order to provide a smooth unbroken ring receiving groove in the finished pipe the groove forming member must necessarily be capable of being freed from the compacted partially set pipe without damage to the grrove it has formed and the adjacent pipe body. In order to overcome this problem various expedients have been proposed, for example, a resilient forming ring has been used which can be stretched radially after the molding and slipped off the pipe while in stretched condition.

Other expedients including a forming ring in segments which are separated for removal and to make the forming member as a spring type split ring which is initially sprung closed against the spigot for forming by an arrangement of screws or bolts and released to spring open for its removal.

U.S. Pat. No. 3,341,910 discloses an apparatus for forming concrete pipes including a removable profile ring to form the "O" ring chamber or recess commonly known in the industry.

U.S. Pat. No. 3,114,956 teaches the manufacture of concrete pipe to form the bell end and male end of the pipe accurately to facilitate the installation and joining of the pipe sections and to provide a dependable leakproof seal at the joint. The abutment surface, the tapered surface and the gasket groove comprise the sides and bottom under precise dimension and concentricity so as to properly mate with the abutment surface and tapered bore of the bell end of the pipe so that the gasket forms a proper seal at the pipe joint. Ordinarily the concrete pipe sections are cast in a vertical position with the bell end down, the outer surface of the pipe being formed by the outer mold which rests on a suitable platform while the aggregate is dumped in at the top and the mold structure subjected to suitable vibration to compact the material. The bore of the pipe is formed and troweled smooth by the core element which rises up through the mold as the material is fed in above and around the core element which finally emerges from out of the upper end of the pipe. The male end of the pipe is formed by a specially constructed molding ring comprising a plurality of molding ring segments having radially disposed abutment ends when the segments are placed together. Each of the segments have the annular ring portion formed on the tapered bore surface thereof for forming the gasket groove in the pipe. The radially disposed surface of the ring forms the abutment surface on the upper end of the pipe while the radially disposed surface forms the clearance surface on the pipe. The exterior of the ring is formed with an outwardly downwardly sloping surface which matingly engages the tapered bore in the header ring so that downward pressure on the top surface of the header ring firmly and accurately locks the ring segments in position abutment contact at radially disposed abutment end parting lines to form a continuous rigid ring engaging the male end of the pipe. Suitable clearance is provided between the ring and the header for proper sealing and aligning action between the tapered surfaces. The functioning and operation of the structures are identical, except that in the latter group two segments are used instead of three segments. The assembled device is placed in the bore of the outer mold at the upper end thereof and initially supported on any suitable releasable means such as the pull pins carried in the outer mold. The top surface of the header ring is backed up by the thrust platen of the pipe making machine so that the upward thrust caused by the upward movement of the core element in forcing the concrete outwardly and upwardly against the ring segments is absorbed through the header ring to thereby automatically maintain the segments in tight aligned abutting contact through the operation of the tapered surfaces as described so that the greater the outward and upward forces against the segments, the tighter will be the tapered locking action thereon by the header ring. After the pipe has been cast, the operator partially rotates the assembly to improve the finish of the pipe and create a trowelled finish. Then the core element fully upwardly withdrawn and the thrust platen withdrawn, the cast pipe in the outer mold is moved from the machine to the curing area. The outer mold is then pulled upwardly from the cast pipe leaving the gasket groove forming device on top of the cast pipe. The following day, a screw driver or pinch bar is placed in the clearance groove to release the header ring from the segments whereupon the segments are moved radially away from the pipe leaving the complete perfectly formed male end of the pipe to set up and age.

U.S. Pat. No. 3,124,857 relates to the manufacure of concrete pipe and more particularly to improvements in the preparing of concrete pipe sections for interconnection. This is accomplished by providing a spigot groove former which consists basically of three (3) main parts namely, an L-shaped bottom ring supporting a plurality of supporting brackets, stoppers and a locating bracket, a removable top ring which is either rectangular or L-shaped, depending on the type of molding process as will be described and which is secured to the bottom ring through the supporting brackets by provide an annular space in which will slide the third element, namely a retractible middle ring. The retractible middle ring which can be rectangular, or preferably a U-shaped channel to maintain flexibility is split with the open ends connected by a toggle clamp arrangement. A plurality of stoppers and a locating lug are provided on the retractible ring which, in combination with the bottom and top rings make the retractible ring self-centering when closed by the toggle clamp. The interior faces of the bottom and top rings are machined so that they acurately form the spigot and offer support to the concrete when the middle ring is retracted. In use, the groove former is supported directly on the upper end of the pipe mold over the partially compacted pipe and the forming ring reduced in diameter by the toggle clamp to form the desired groove. When the concrete is fully compacted and set to a degree permitting removal of the mold, the toggle is opened forcing the retractible ring outwards until it contracts the stoppers provided on the bottom ring thus clearing the groove formed and permitting removal of the former as a unit.

U.S. Pat. No. 3,139,469 shows a method for forming machine-made concrete pipe with permanent sealing inserts to provide a premium joint comprising placing a plastic bell sealing insert on a bell pallet, securing an outside pipe forming jacket around the bell pallet so that the bell pallet is supported thereon, placing a rubber gasket in a groove on a plastic spigot sealing insert, positioning said spigot insert on a spigot pallet so that the gasket is received in a recess on the spigot pallet, positioning and securing the spigot to the outside pipe forming jacket and filling the pipe forming jacket with a no-slump concrete mix.

U.S. Pat. No. 4,522,669 discloses a method of manufacturing a combination mold portion and protective element from a flat cut blank material subject to dimensional changes and using said element to protect and form joint surfaces formed in a socket portion of a concrete pipe adapted to be connected to another pipe, comprising the steps of transporting at least one flat cut blank to a site where the concrete pipe is to be poured, forming at least one of the blanks into an annular shaped element by progressively feeding the blank along an inner annular peripheral surface of an annular shaping device, positioning the annular shaped mold portion element in relation to a pair of side mold portions and a bottom ring mold portion to define therewith a cavity forming said socket portion of the pipe, pouring concrete into the cavity to form the socket portion, the annular shaped mold portion element defining inner surfaces of the socket portion adapted to sealingly connect with another pipe and removing the side mold portions and bottom ring mold portion after the concrete has hardened, the annular shaped element being left intact in tight fitting engagement to protect inner surfaces of the socket portion against contact with water or soil during transportation and storage of the pipe. The mold includes an outer and inner portion in combination with a bottom ring. A sealing ring is embedded into the bell of the concrete pipe immediately adjacent a protective element removably secured to the bell portion by tape.

U.S. Pat. No. 2,559,296 teaches a composition pipe mold of the type having an inner mold section and a concentrically disposed outer mold section wherein each section is formed from metal plates and the ends of the metal plates are arranged in overlapping relationship and means for securing the ends of the outer mold section. The improvement comprising a bracket adjacent each free edge of the plate forming the inner mold section, a clamp engaging the brackets whereby the plate will be held in a substantially tubular form, an inclined guideway adjacent each free edge of the plate near the lower end thereof and a wedge element adapted to be lodged in the guideways to prevent the collapse of the plate when in tubular form.

Unfortunately the production and use of "O" ring grooves have significant limitations. Specifically such structures are difficult to produce, hard to repair damaged pipe and require lubrication in groove during pipe line assembly to prevent the "O" ring from moving out of the groove that could break the bell destroying the water integrity of the pipe line.

In contrast, a single offset notch formed on the spigot or grooveless pipe permits the use of a wide variety of sealing gaskets with more than one point of seal and a greater sealing area.

For example, flat profile gaskets may include multiple surfaces to hold and retain lubricant and distribute pressure load of gasket over an expanded area.

However, replacement of "O" ring groove headers or header pallets would be extremely expensive. Therefore, conversion of "O" ring header pallets to produce a single offset spigot notch with an inexpensive compressible part or structure is dictated without any change to the header. Thus present headers can be used and, if necessary, converted back to the original type with no wear or damage resulting. The system is convertible between a single offset spigot notch or "O" ring header.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
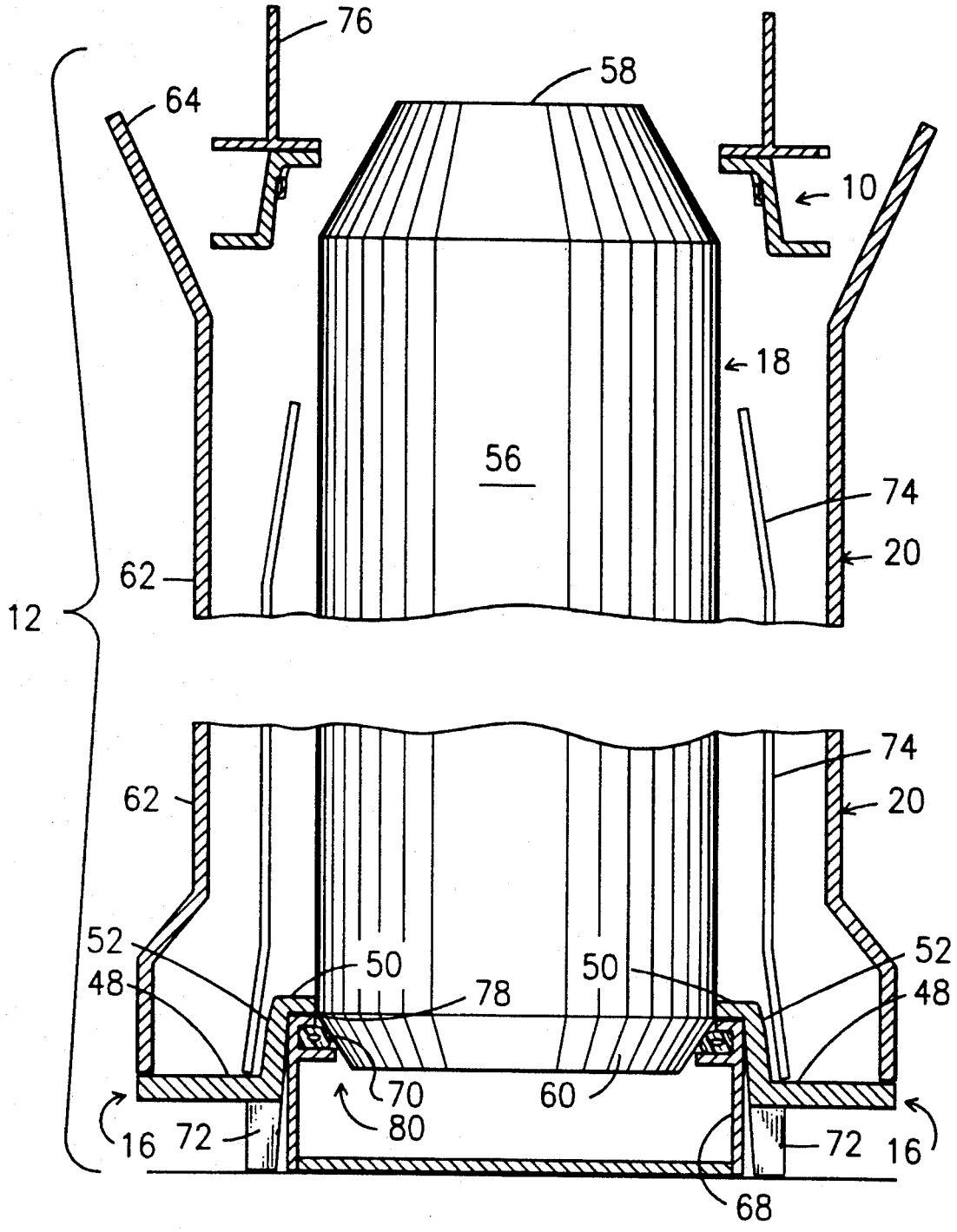
FIG. 1 is a cross-sectional front view of a mold incorporating the header pallet of the present invention.
Figure 4:
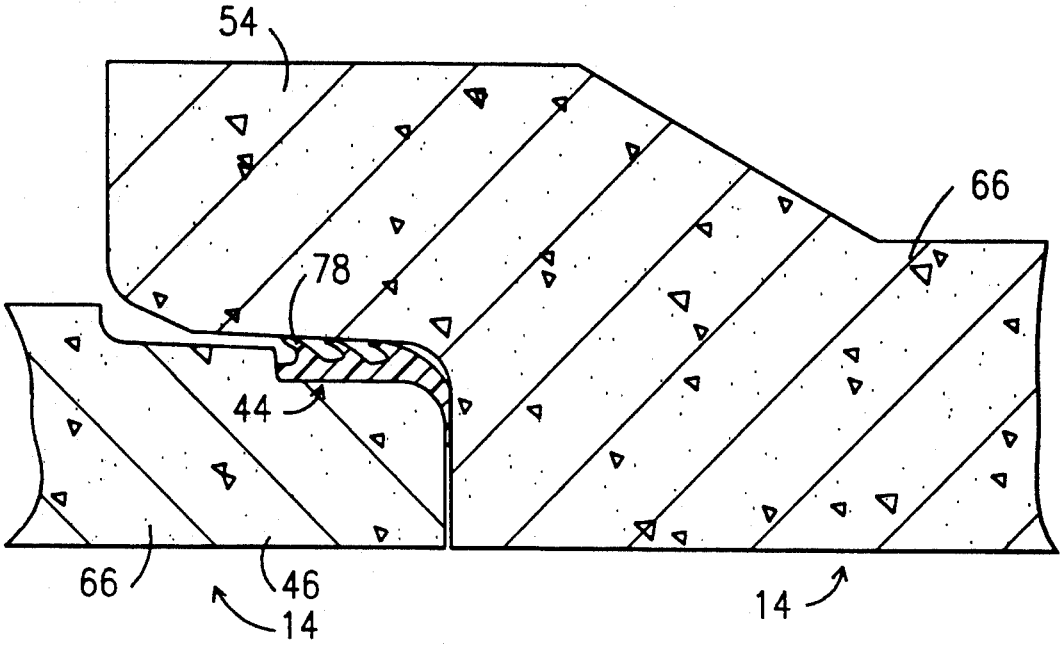
FIG. 4 is a cross-sectional side view of the joint formed between adjacent concrete pipes manufactured by the present invention.
Figure 5:
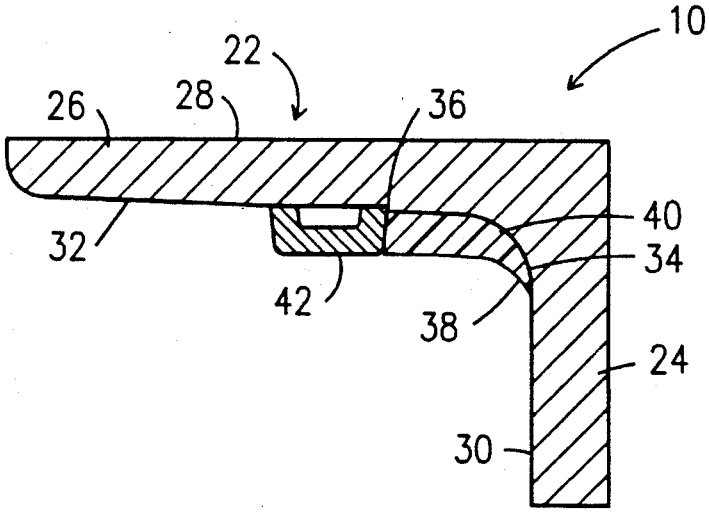
FIG. 5 is a cross-sectional side view of the header pallet of the present invention.

As shown in FIGS. 1 and 5, the present invention relates to a header pallet generally indicated as 10 for use in a mold generally indicated as 12 for the fabrication or production of concrete pipes including a dual offset notch spigot each generally indicated as 14 in FIG. 4.

As best shown in FIG. 1, the mold 12 for use with the header pallet 10 of the instant invention comprises a lower pallet, inner core and outer jacket generally indicated as 16, 18 and 20 respectively.

As best shown in FIG. 5, the header pallet 10 comprises an outer header ring generally indicated as 22 including an end leg portion 24 and a side leg portion 26 to cooperatively form a substantially L-shaped profile 28 wherein the intersection of the inner surface 30 of the end leg portion 24 and the inner surface 32 of the side leg portion 26 are contoured to form a concave surface 34. A shoulder 36 is formed on the inner surface 32 of the side leg portion 26 in spaced relationship relative to the concave surface 34. A removable compressible intermediate ring 38 having a substantially arcuate profile including an outer convex surface 40 and a removable inner snap ring 42 having a substantially rectilinear profile as disposed such that the removable inner snap ring 42 is placed to engage the shoulder 36 in spaced relationship relative to the end leg portion 24 and the removable compressible intermediate ring 38 is press fitted between the removable inner snap ring 42 and the end leg portion 24 with the outer convex surface 40 thereof mating with the concave surface 34 whereby an outer offset notch 44 is formed on the end of the spigot 46 and an inner notch is formed by the end portion of the side leg portion 26 as shown in FIG. 4. The removable compressible intermediate ring 38 may be constructed from extruded rubber of at least 80 durometers.

As shown in FIG. 1, the lower pallet 16 comprises a flat outer end plate 48 and a flat inner base plate 50 held in spaced relationship to each other by an inclined lower pallet forming member 52 configured to cooperatively form the bell 54 of the concrete pipe 14 as shown in FIG. 4.

As shown in FIG. 1, the inner core 18 comprises a body or form 56 having an upper and lower conical tapered end portion indicated as 58 and 60 respectively and the outer jacket 20 comprises a hollow shell 62 having a funnel 64 formed on the upper end thereof to cooperatively form a pipe body 66 of the concrete pipe 14 as shown in FIG. 4.

The method of production of the concrete pipe 14 of the present invention is similar to that described in U.S. Pat. No. 3,584,356. Specifically, the operator first places the lower pallet 16 on a lower pallet saddle 68. A first elastic sealing ring 70 on the lower pallet saddle 68 holds the lower pallet legs 72 slightly above the floor. A reinforcement wire cage 74 is then positioned on the lower pallet 16. The outer jacket 20 is moved downwardly onto the lower pallet 16. At this time the lower pallet legs 72 are in contact with the floor. A header pallet holding and downward forcing member 76 supports the header pallet 10.

The inner core 18 is lowered onto the lower pallet saddle 68 to form a liquid-tight mold with the elastic sealing ring 70. The lower conical tapered end portion 60 engages the inner surface 78 of a centrally disposed aperture 80 formed in the flat inner base plate 50 to align the inner core 18 relative to the outer jacket 20 and lower pallet 16.

A concrete distributor (not shown) is positioned to feed concrete to the mold 12 between the inner core 18 and outer jacket 20. The mold 12 is vibrated to evenly settle the concrete therein. When the mold 12 is filled to the proper height, the header pallet 10, secured to the header pallet holding member 76, is moved downwardly onto the concrete mass relative to the lower pallet 16, inner core 18 and outer jacket 20 to form the pipe 14. Once the pipe 14 is formed, the upper pallet holding member 76 releases the upper pallet 10 moving upwardly to release the pressure. Once the concrete pipe 14 is manufactured, the inner core 18 and outer jacket 20 are stripped therefrom. The cycle is ready to repeat. After the concrete pipe 14 is cured, the top and bottom pallets are removed.

Thus constructed, a pipe line may be assembled as shown in FIG. 4 where the spigot 46 having a sealing gasket 78 inserted in the single offset notch 44 is mated with the bell 54 of the next adjacent concrete pipe 14.

Figure 2:
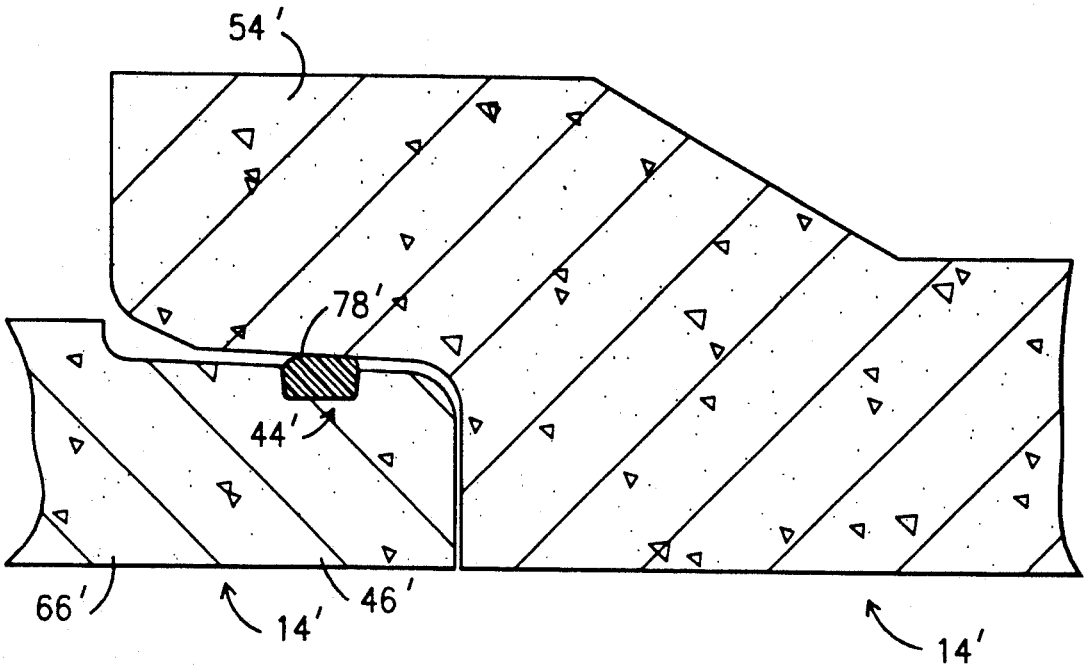
Fig. 2 PRIOR ART
FIG. 2 is a cross-sectional side view of the joint formed between adjacent concrete pipes of the prior art.
Figure 3:
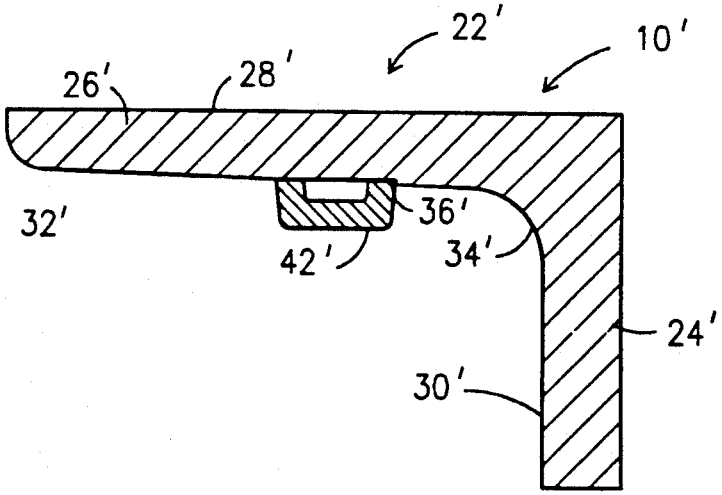
Fig. 3 PRIOR ART
FIG. 3 is a cross-sectional side view of a header pallet of the prior art.

As shown in FIGS. 2 and 3, the production of the standard "O" ring pipe 14' is similar except that the header pallet 10' comprises an outer header ring generally indicated as 22' including an end leg portion 24' and a side leg portion 26' to cooperatively form a substantially L-shaped profile 28' wherein the intersection of the inner surface 30' of the end leg portion 24' and the inner surface 32' of the side leg portion 26' are contoured to form a concave surface 34'. A shoulder 36' is formed on the inner surface 32' of the side leg portion 26' in spaced relationship relative to the concave surface 34'. A removable inner snap ring 42' is placed to engage the shoulder 36' in spaced relationship relative to the end leg portion 24' whereby a groove 44' is formed on the spigot 46' of the concrete pipe 14 as shown in FIG. 2.

As constructed, a pipe line may be assembled as shown in FIG. 2 where the spigot 46' having an "O" ring 44' inserted into the groove 44' is mated with the bell 54' of the next adjacent concrete pipe 14'.

Thus the principal difference between the prior art header pallet 10' and the header pallet 10 of the instant invention is the addition of the removable compressible intermediate ring 38 capable of forming the outer offset notch 44. This unique combination of structural elements allows manufacturers to convert existing "O" ring header pallets 10' to the single offset notch header pallet 10' at a nominal cost.

Of course, since the addition of the removable compressible intermediate ring 38 does not destroy the existing structure, the header pallet 10 can also be used to selectively manufacture the "O" ring groove pipe 14'.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A convertible header pallet for the selective production of the spigot of a concrete pipe having either a single offset notch and "O" ring groove spigot or a dual offset notch spigot including an outer notch formed on the end of the spigot and an inner notch formed inwardly from the outer notch comprising an outer header ring including an end leg and a side leg including an end portion to cooperatively form a substantially L-shaped profile wherein the intersection of the inner surface of said end leg and the inner surface of said side leg comprises a concave surface and a shoulder is formed on the inner surface of said side leg portion in spaced relationship relative to said end leg portion, a removable intermediate ring having a substantially arcute profile and including a convex surface obverse to said concave surface of said intersection and a removable inner snap ring having a substantially rectilinear profile such that when said removable inner snap ring is placed to engage said shoulder in spaced relationship relative to said end leg said single offset notch is formed on the end portion of the spigot by said side leg and said "O" ring groove is formed in said single offset notch by said removable inner snap ring and when said removable inner snap ring is placed to engage said shoulder in spaced relationship relative to said end leg portion and said removable intermediate ring is press fitted between said inner snap ring and said end leg with said convex surface thereof mating with said concave surface of said intersection said outer notch is cooperatively formed on the outer end of the spigot by said removable intermediate ring and said removable inner snap ring and said inner notch is formed by said end portion of said side leg portion on the spigot inwardly of said outer notch.

* * * * *